US007484674B1

(12) United States Patent
Wang

(10) Patent No.: US 7,484,674 B1
(45) Date of Patent: Feb. 3, 2009

(54) WATER FLOW SWITCHING MECHANISM OF A GEAR-TYPE SPRINKLER

(76) Inventor: Hsin-Fa Wang, No. 68, Mou Tan Lane, Shao An Li, Lu Kang Town, Chang Hua Hsien (TW)

( * ) Notice: Subject to any disclaimer, the term of this patent is extended or adjusted under 35 U.S.C. 154(b) by 0 days.

(21) Appl. No.: 11/857,159

(22) Filed: Sep. 18, 2007

(51) Int. Cl.
*B05B 3/00* (2006.01)
*B05B 3/08* (2006.01)

(52) U.S. Cl. ..... 239/263.3; 239/232; 239/261; 239/251; 239/258; 239/263

(58) Field of Classification Search ..... 239/363.3, 239/232, 251, 259, 258, 233.3
See application file for complete search history.

(56) References Cited

U.S. PATENT DOCUMENTS 3,523,647 A * 8/1970 Radecki ..... 239/206
5,975,430 A * 11/1999 Larsen ..... 239/205
6,820,825 B1 * 11/2004 Wang ..... 239/457
2007/0119978 A1 * 5/2007 Wang et al. ..... 239/242

FOREIGN PATENT DOCUMENTS

GB 2406805 A * 4/2005

* cited by examiner

*Primary Examiner*—Len Tran
*Assistant Examiner*—James S Hogan
(74) *Attorney, Agent, or Firm*—Egbert Law Offices PLLC

(57) ABSTRACT

The present invention provides an improved water flow switching mechanism of a gear-type sprinkler, which addresses problems of typical gear-type sprinklers, such as invalid water switching and poor stability. The gear-type sprinkler includes a water inlet portion, a water outlet portion and accommodating space. A convex framework is additionally placed onto the accommodating space opposite the separate water outlets. Two lateral grooves are defined in the convex framework, each corresponding to a water outlet. So the pivotal portion of the rotary switching seat is assembled centrally into the convex framework. The rotary switching seat is provided with two opposite extension flanges. The extension flange may block the lateral groove of the convex framework in line with the swinging direction of the rotary switching seat. The water-stop area of rotary switching seat is greatly increased, thus ensuring the stability of the water flow switching state and improving performance of the sprinkler.

5 Claims, 5 Drawing Sheets

WATER FLOW SWITCHING MECHANISM OF A GEAR-TYPE SPRINKLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a gear-type sprinkler, and more particularly to an innovative sprinkler with a water flow switching mechanism.

2. Description of Related Art Including Information Disclosed Under 37 CFR 1.97 and 37 CFR 1.98.

Said gear-type sprinkler refers to a sprinkler structure that includes a change gear set and rotary vane assembled in the main body. The rotary vane is driven by water flow, and the change gear set is coupled to automatically change water flow or spraying direction. This gear-type sprinkler is generally provided with a water flow switching mechanism, whereby the water flow is switched to change the direction of relevant components (e.g. the aforementioned change gear set, rotary vane). The purpose of the present invention is to improve said water flow switching mechanism.

As shown in a typical gear-type sprinkler structure disclosed in Taiwan Patent No. 1273883, entitled "Automatic Water Switching Mechanism of Sprinkler", this water switching mechanism is designed in such a manner that the watertight surface formed at both bottom ends of the movable swinging seat contacts tightly with either of two water outlets on the linkage seat. At the top of movable swinging seat, the push rod and toggle member are assembled to control the swinging direction of the movable swinging seat (similar to the motion of wane).

However, there are shortcomings observed during actual applications. For instance, as for the movable swinging seat of a typical automatic water switching mechanism, two watertight surfaces at the bottom contact tightly with either of two water outlets on the linkage seat for water control. In such a case, the watertight surface area is extremely small, and the movable swinging seat is a swinging movable member. The inclination state can only be supported by the top toggle member. So, the water pressure for the pressed water outlet may easily crowd out the watertight surface. The inclination state of the movable swinging seat cannot be maintained stable, leading to influencing normal operation of the sprinkler by invalid water flow switching.

Thus, to overcome the aforementioned problems of the prior art, it would be an advancement in the art to provide an improved mechanism that can significantly improve efficacy.

Therefore, the inventor has provided the present invention of practicability after deliberate design and evaluation based on years of experience in the production, development and design of related products.

BRIEF SUMMARY OF THE INVENTION

A convex framework 50 is additionally placed onto the accommodating space 13 opposite to separate water outlets 21, 22. Two lateral grooves 51, 52 are defined in the convex framework 50, each of which corresponds to two water outlets 21, 22. Two extension flanges 411, 412 of rotary switching seat 41 may block the lateral groove 51 or groove 52 of convex framework 50 in line with the swinging direction of rotary switching seat 41. This may increase greatly the water-stop area of rotary switching seat 41, thus ensuring the stability of water flow W switching state and improving the performance of sprinkler.

Based upon the present invention, two lateral grooves 51, 52 are defined in said convex framework 50, and rotary switching seat 41 is also provided. The groove 51 or 52 can be blocked through the swinging behavior. Unlike the prior art situation that said movable swinging seat swings like a wane and that the excessive water flow leads to a poor water-stop effect since two watertight surfaces at the bottom of movable swinging seat cannot be blocked tightly, the present invention may realize a water-tightness effect.

An oblique surface 413 is formed at a bottom of said extension flange 411, 412. When the cylindrical rotary switching seat 41 inclines towards the lateral groove 51 or groove 52, the contact area between oblique surface 413 and inner wall of groove becomes bigger. Thus, the rotary switching seat 41 and oblique surface 413 form a three-side water-stop surface with the inner wall of groove 51 or groove 52, presenting a better water flow W switching effect.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
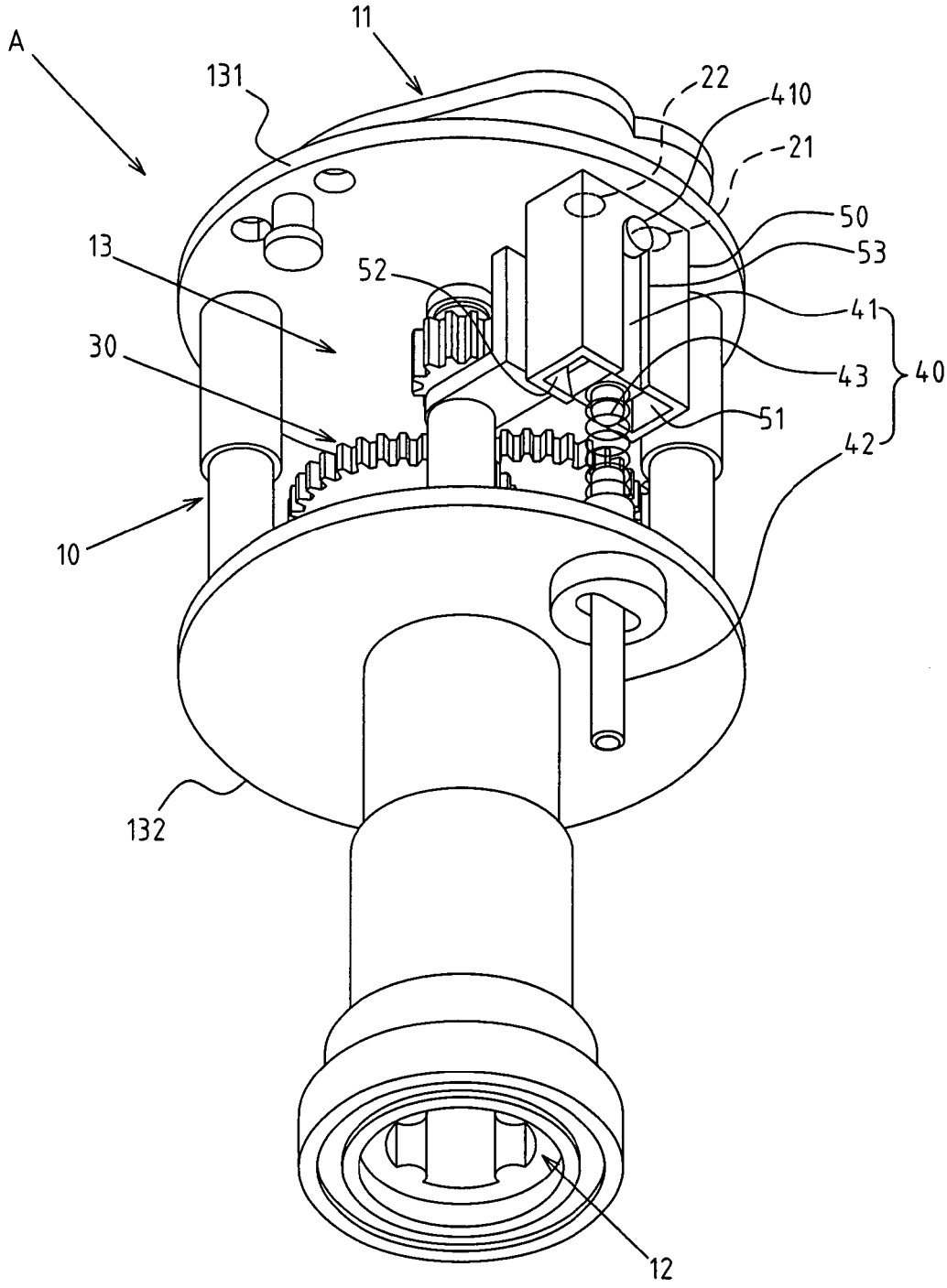
FIG. 1 shows an assembled perspective view of the present invention.
Figure 2:
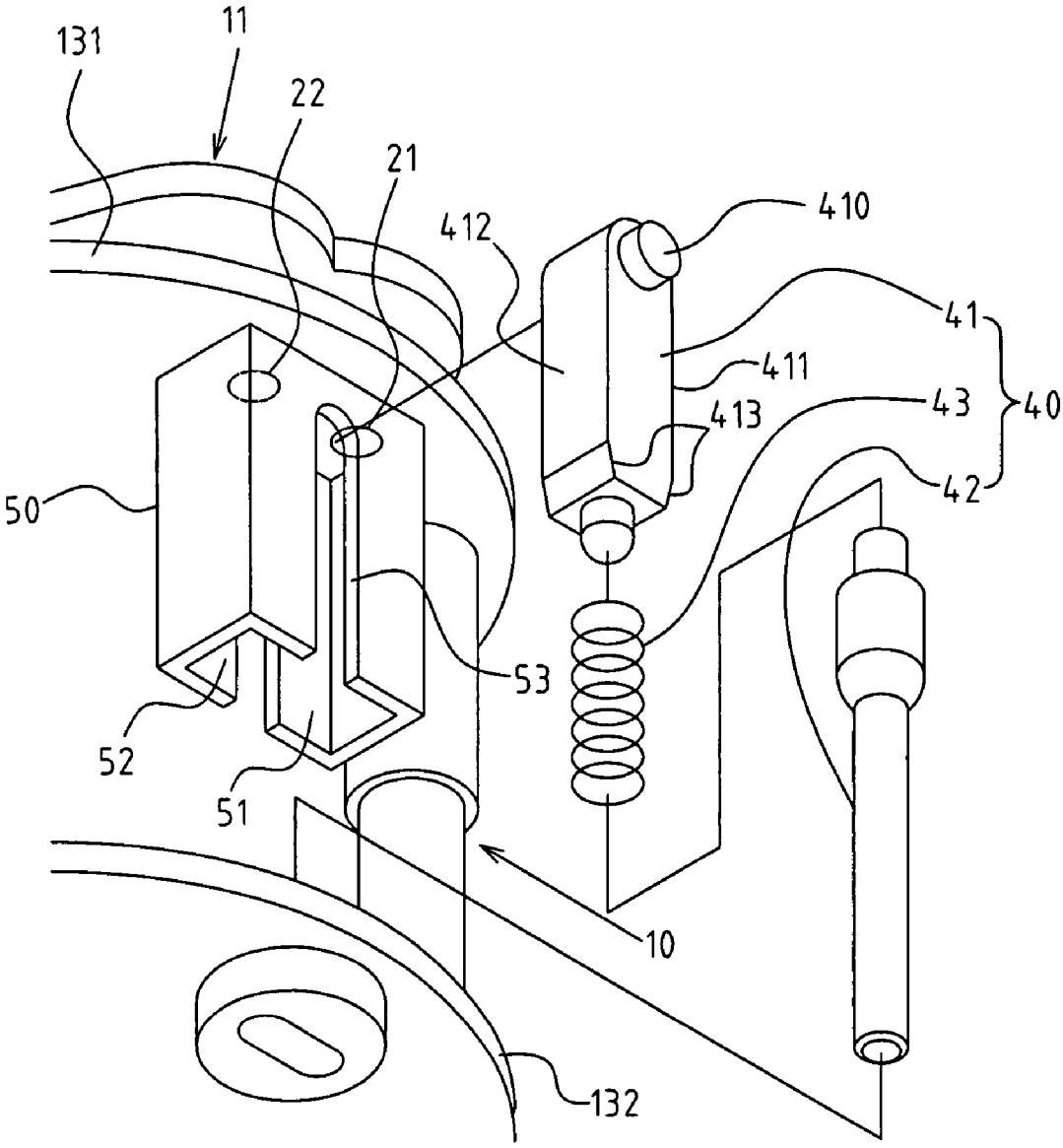
FIG. 2 shows a partially exploded perspective view of the present invention.
Figure 3:
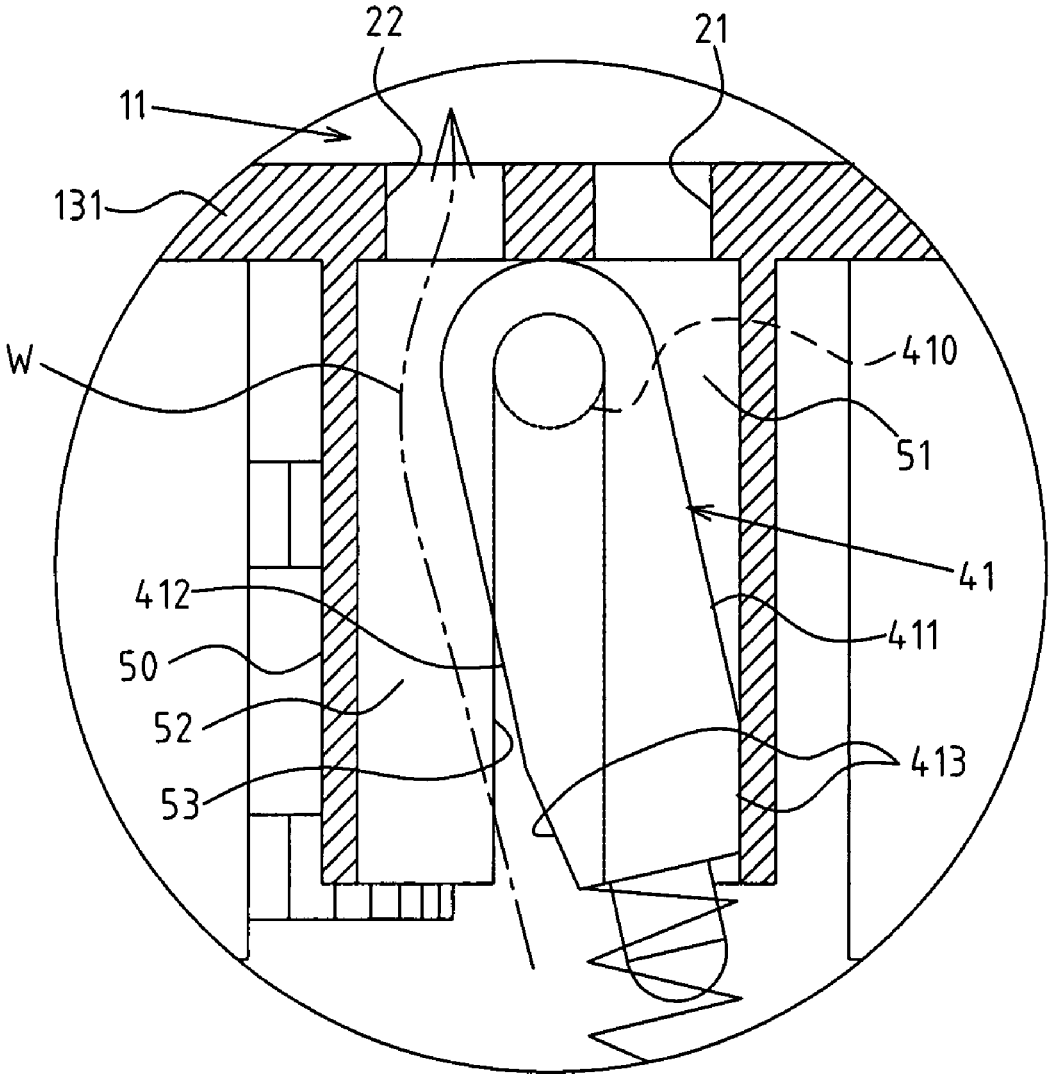
FIG. 3 shows a sectional view of a partial structure of the present invention.
Figure 5:
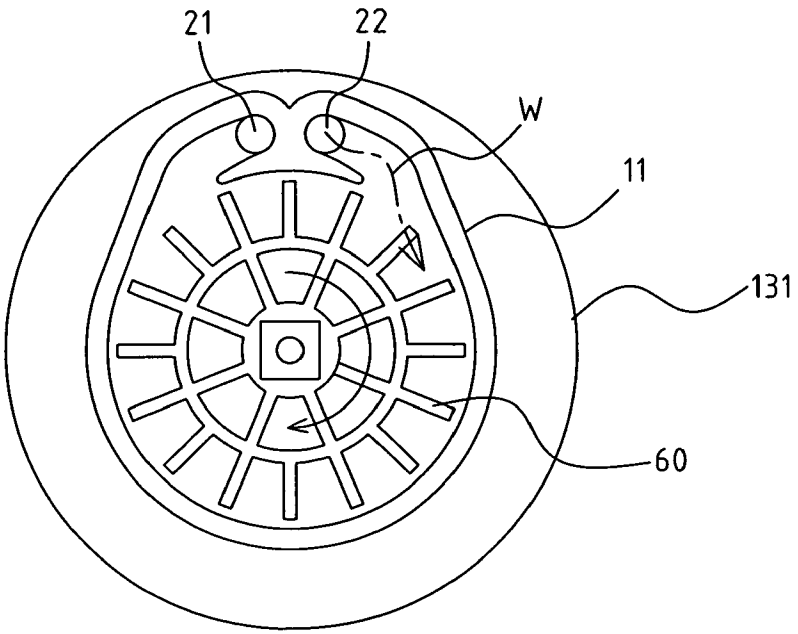
FIG. 5 shows a schematic view of the operation of the rotary vane of water outlet portion as shown in FIG. 4.
Figure 4:
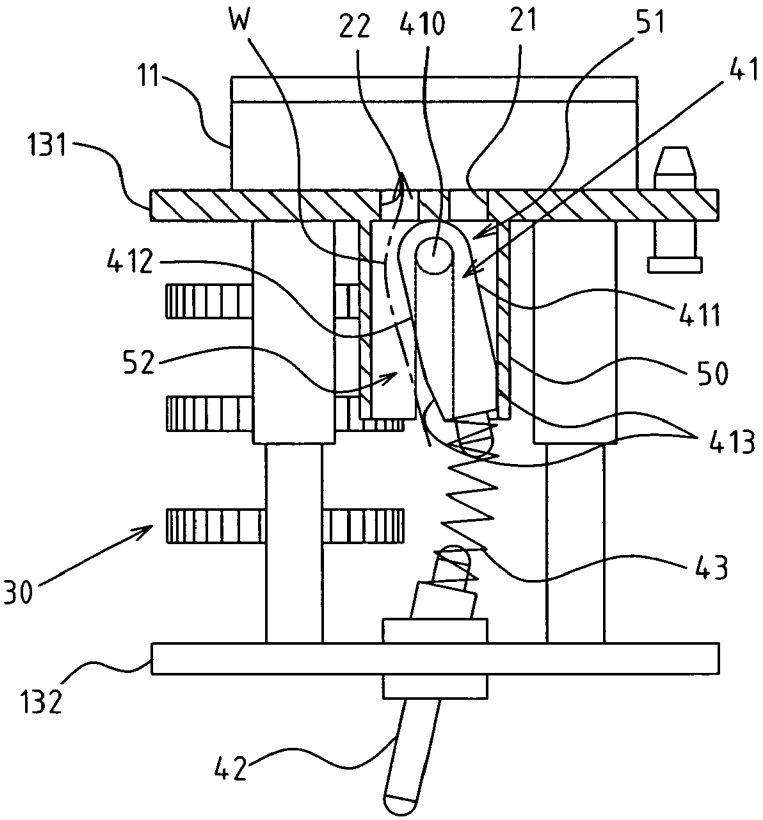
FIG. 4 shows a schematic view of the water flow switching state of the present invention.

The features and the advantages of the present invention will be more readily understood upon a thoughtful deliberation of the following detailed description of a preferred embodiment of the present invention with reference to the accompanying drawings.

FIGS. 1-7 depict preferred embodiments of a water flow switching mechanism of a gear-type sprinkler of the present invention. The embodiments are provided only for explanatory purposes. The scope of the present invention is set by the patent claims.

The main foundation 10 of said gear-type sprinkler A comprises a water outlet portion 11, a water inlet portion 12 and an accommodating space 13. Two water outlets 21, 22 are linked to water outlet portion 11 at upper wall 131 of accommodating space 13. Change gear set 30 and water flow switching mechanism 40 are mounted into the accommodating space 13. The water flow switching mechanism 40 comprises a rotary switching seat 41, a push rod 42 and a coupling member 43 (or a helical spring). The rotary switching seat 41 is used to switch the opening/closing of two water outlets 21, 22. The push rod 42 is mounted onto the lower wall 132 of the accommodating space 13, while the coupling member 43 is mounted between push rod 42 and rotary switching seat 41.

A convex framework 50 is additionally assembled onto upper wall 131 of accommodating space 13 opposite to two water outlets 21, 22. Two lateral grooves 51, 52 are defined in the convex framework 50, each of which corresponds separately to water outlets 21, 22, so that the pivotal portion 410 of the rotary switching seat 41 is assembled centrally into the convex framework 50. The rotary switching seat 41 is of a cylinder shape, and two opposite extension flanges 411, 412 are defined. The extension flange 411, 412 may block the lateral groove 51 or groove 52 of convex framework 50 in line with the swinging direction of rotary switching seat 41. Oblique surface 413 is arranged oppositely at a bottom of two extension flanges 411, 412 of the rotary switching seat 41.

A vertical groove 53 is placed centrally into the convex framework 50, so that pivotal portion 410 of the rotary switching seat 41 is a camshaft for embedding into the vertical groove 53. The cross section of convex framework 50 is of a rectangular shape, and the rotary switching seat 41 is a cylinder with a rectangular cross section.

Based upon above-specified structures, the present invention operates as follows:

Referring to FIGS. 1, 3, 4, and 5, the gear-type sprinkler A is assembled into a sprinkler head. When said gear-type sprinkler A is activated, water flow W is fed from water inlet portion 12. Since the extension flange 411 of the rotary switching seat 41 shifts towards the groove 51, the push rod 42, coupling member 43 and rotary switching seat 41 form a > shape, and the oblique surface 413 at top of extension flange 411 also contacts the inner wall of the groove 51 for a bigger contact area. At one side of the groove 51, a space for blocking water flow W is formed, then water flow W can be discharged from water outlet 22 at one side of the groove 52, so that water flow W pushes rotary vane 60 in a clockwise direction, thus driving the change gear set 30 to permit rotary spraying of sprinkler head.

Figure 7:
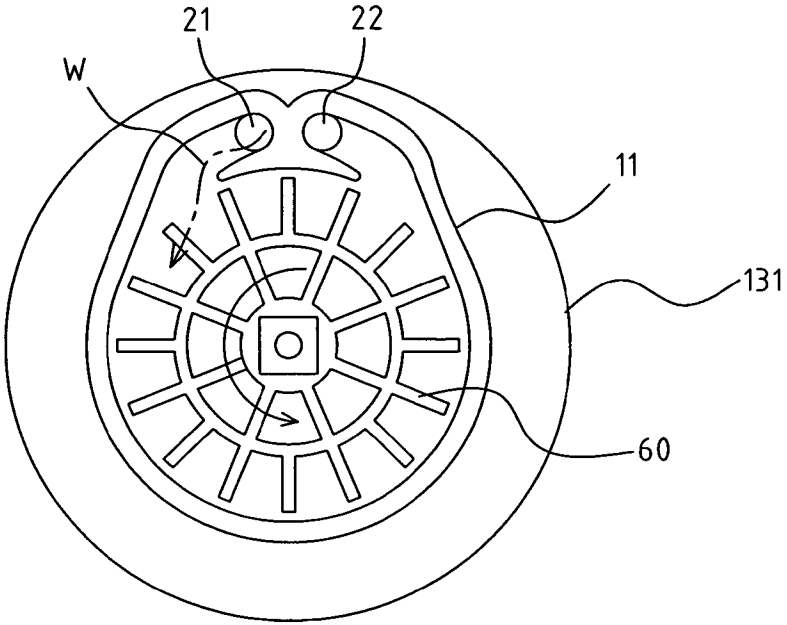
FIG. 7 shows another schematic view of the operation of the rotary vane of the water outlet portion as shown in FIG. 6.
Figure 6:
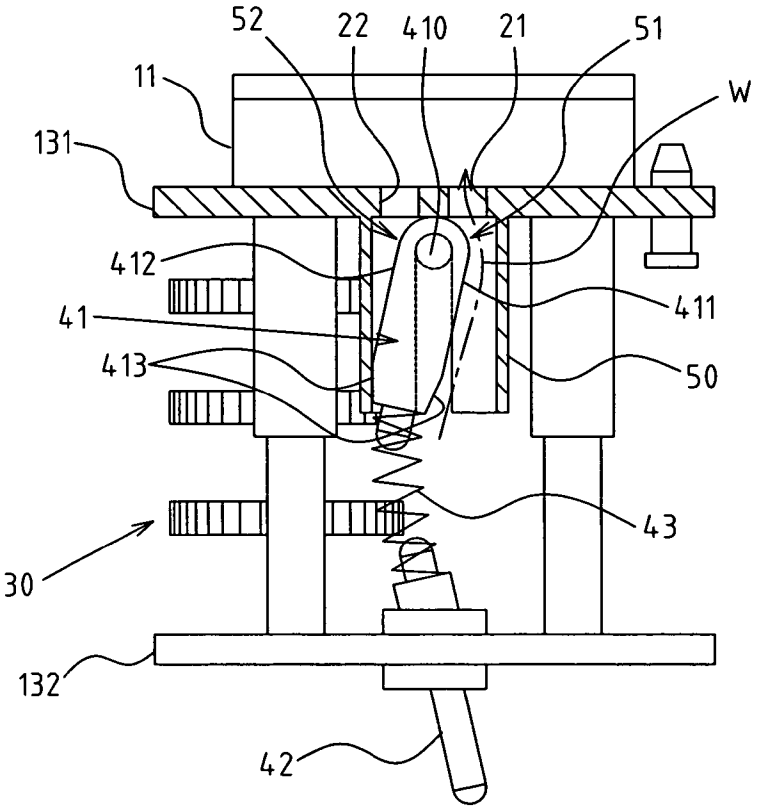
FIG. 6 shows another schematic view of the water flow switching state of the present invention.

Referring to FIGS. 6 and 7, when said push rod 42 swings, the coupling member 43 linked to the push rod 42 is driven to drag the rotary switching seat 41, so the rotary switching seat 41 swings towards the groove 52 by taking pivotal portion 410 as a pivot point. In such a case, the push rod 42, coupling member 43 and rotary switching seat 41 form a < shape. The extension flange 412 and oblique surface 413 will prevent water flow W from entering into the groove 52, so water flow W has to be discharged from water outlet 21 at one side of the groove 51. Then, the rotary vane 60 is driven by water flow W for counterclockwise rotation, thus driving the change gear set 30 to permit rotary spraying of sprinkler head.

Through the switching and swinging of said push rod 42, the gear-type sprinkler A is allowed for clockwise and counterclockwise rotary spraying.

I claim:

1. A water flow switching mechanism of a gear-type sprinkler, said gear-type sprinkler comprising a water inlet portion, a water outlet portion and an accommodating space, said water outlet portion having two water outlets linked thereto at an upper wall of said accommodating space, said accommodating space having a change gear set, said water flow switching mechanism comprising:

a rotary switching seat, mounted into said accommodating space;

a push rod, mounted on a lower wall of said accommodating space;

a coupling member, wherein said rotary switching seat switches opening and closing of said two water outlets, said coupling member being mounted between said push rod and said rotary switching seat; and a convex framework being assembled onto said accommodating space opposite to said two water outlets, said convex framework having two lateral grooves defined thereon and corresponding to said two water outlets, said rotary switching seat having a pivotal portion assembled centrally into said convex framework, said rotary switching seat having a cylinder shape and two opposite extension flanges defined thereon, the extension flanges blocking a lateral groove in line with a swinging direction of said rotary switching seat.

2. The mechanism defined in claim 1, wherein said convex framework further comprises a vertical groove is placed centrally therein, said rotary switching seat having a pivotal portion as a camshaft embedded into said vertical groove.

3. The mechanism defined in claim 1, wherein said convex framework has a cross section of a rectangular shape, said rotary switching seat being a cylinder with a rectangular cross section.

4. The mechanism defined in claim 1, wherein said rotary switching seat has an oblique surface is formed opposite at a bottom of two extension flanges.

5. The mechanism defined in claim 1, wherein said coupling member is a helical spring.

* * * * *